United States Patent [19]

Hammerl

[11] Patent Number: 4,853,508

[45] Date of Patent: Aug. 1, 1989

[54] LIGHTING DEVICE FOR AN OVEN TO BE EXPOSED TO MICROWAVE ENERGY, IN PARTICULAR A HOUSEHOLD OVEN

[75] Inventor: Günter Hammerl, Bad Reichenhall, Fed. Rep. of Germany

[73] Assignee: Bosch-Siemens Hausgeräte GmbH, München, Fed. Rep. of Germany

[21] Appl. No.: 285,009

[22] Filed: Dec. 15, 1988

[30] Foreign Application Priority Data

Dec. 15, 1987 [DE] Fed. Rep. of Germany ..... 3742518

[51] Int. Cl.[4] ..... H05B 6/76; F24C 7/02

[52] U.S. Cl. ..... 219/10.55 R; 219/10.55 D; 219/10.55 E; 362/92; 174/35 R

[58] Field of Search ..... 219/10.55 R, 10.55 B, 219/10.55 D, 10.55 E; 362/92; 126/19 R, 255, 275 R; 361/117, 212; 174/35 R

[56] References Cited

U.S. PATENT DOCUMENTS 4,326,243 4/1982 Pistor et al. ..... 302/92 X
4,559,585 12/1985 Almgren et al. ..... 219/10.55 R
4,621,180 11/1986 Kristof et al. ..... 219/10.55 R
4,763,638 8/1988 Hurley et al. ..... 219/10.55 B

FOREIGN PATENT DOCUMENTS 2187369 9/1987 Fed. Rep. of Germany .. 219/10.55 D

*Primary Examiner*—Philip H. Leung
*Attorney, Agent, or Firm*—Herbert L. Lerner; Laurence A. Greenberg

[57] ABSTRACT

A lighting device for an oven, in particular a household oven, includes a baking chamber with a wall to be exposed to microwave energy, a lamp socket protruding freely into the baking chamber without a microwave shielding covering, electrical connecting lines supplying the lamp socket with current from outside the baking chamber, and an incandescent bulb with a lamp base and an incandescent filament with an incandescent coil being mounted on the lamp socket. An electrically conductive disk is substantially parallel to and electrically conductively connected to the baking chamber wall. The disk has a duct opening formed therein for the lamp base, and the disk surrounds the incandescent filament in the vicinity of the incandescent coil.

5 Claims, 2 Drawing Sheets

Figure 1:
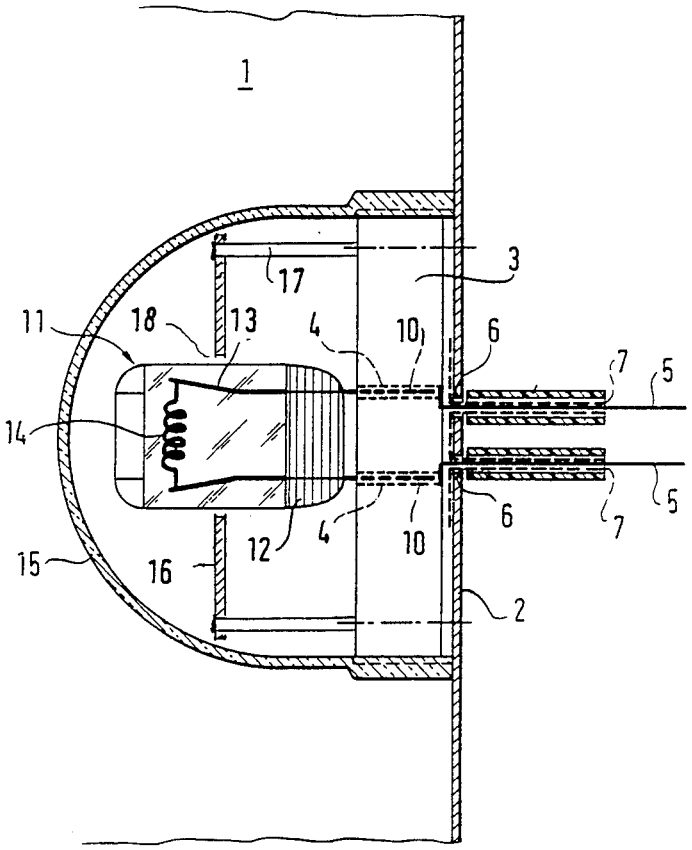

LIGHTING DEVICE FOR AN OVEN TO BE EXPOSED TO MICROWAVE ENERGY, IN PARTICULAR A HOUSEHOLD OVEN

The invention relates to an oven, in particular a household oven, having a baking chamber or space to be acted upon by microwave energy, an incandescent bulb mounted on a lamp socket so as to protrude freely into the baking space without a shield shielding it from microwaves, and electrical connecting lines supplying the socket with current from outside the baking space.

In microwave ovens or microwave ranges with or without additional thermal heating sources, lighting devices having incandescent filament bulbs are typically used to light the baking space. The lighting devices may be disposed on the the baking space wall, for instance, in the vicinity of one of the side walls or the upper wall of the baking space. In this connection, as is well known, a relatively large opening must be provided in the baking space wall, behind which the lamp base of the lighting device is secured, virtually outside the oven space. Particular provisions must be made in this region, to prevent the escape of microwaves out of the baking space through these openings. Moreover, proper account must be taken of the fact that the incandescent bulbs with their filaments and filament holders act as receiving antennae for the microwave energy introduced into the baking space. The voltages induced in these lamp systems generate currents that among other effects cause flows of current to outside and through the filaments. The coils of conventional lamp configurations can be and are brought to incandescence if the bulb protrudes freely into the oven space, that is without being shielded from the microwaves, simply due to the action of these currents. The incandescent lamps typically used can be quickly destroyed from overload whenever these currents exceed the currents supplied for proper lighting, if not before. Since the electromagnetic microwave field inside the baking space moves around within it, partly in order to attain the most uniform possible action in the baking space, the lighting devices exposed to microwave energy usually illuminate the space intermittently, which is annoying.

For these reasons, it is the usual practice to take provisions for preventing irradiation of the microwave energy to the incandescent bulb of the lighting device, or at least for reducing it. The most common protective provision used is to shield the lighting device from the space upon which microwave energy can act by means of a so-called perforated screen of electrically conductive material that contacts the baking space wall. Since the incandescent bulbs should be accessible from the baking space and since it should be possible to change them, especially in built-in fixtures, the perforated screen must be detachably secured to the baking space wall, which again presents problems in microwave shielding. The most disadvantageous feature, however, is that the yield of light is greatly reduced as it passes through the perforated screen. In order to sufficiently illuminate the baking space, suitable high-power bulbs must be used, which again present additional problems because of their pronounced production of heat.

It has also already been suggested to recess the incandescent bulbs behind the baking space wall and to construct the receptacle shaft for the bulb in the form of so-called microwave traps. Once again, this provision meets with considerable difficulties in practical conditions. When so-called low-voltage lamps are used, which are typically operated with voltages below 30 volts and are distinguished by the fact that their dimensions and particularly the dimensions of the incandescent coil are substantially shorter than in incandescent bulbs for higher operating voltages, the danger of impairment from microwave energy is substantially reduced.

It is accordingly an object of the invention to provide a lighting device for an oven to be exposed to microwave energy, which overcomes the hereinafore-mentioned disadvantages of the heretofore-known devices of this general type, which is simple in construction and which precludes any effect upon the lighting device from the microwave energy introduced into the oven, to the maximum possible extent. Proper account should be taken of the object of preventing particularly intensive microwave fields from forming and being capable of affecting the bulb in the area near the lighting device and in particular near the incandescent coil of the bulb.

With the foregoing and other objects in view there is provided, in accordance with the invention, a lighting device for an oven, in particular a household oven, comprising a baking chamber with a wall to be exposed to microwave energy, a lamp socket protruding freely into the baking chamber without a microwave shielding covering, electrical connecting lines supplying the lamp socket with current from outside the baking chamber, an incandescent bulb with a lamp base and an incandescent filament with an incandescent coil being mounted on the lamp socket, and an electrically conductive disk being substantially parallel to and electrically conductively connected to the baking chamber wall, the disk having a duct opening formed therein for the lamp base, and the disk surrounding the incandescent filament in the vicinity of the incandescent coil.

By using the structure according to the invention, the grounding potential of the housing wall in the vicinity of the lighting device is shifted partly into a plane in or near the vicinity of the filament, so that in this vicinity, intensive microwave fields that could have problematic effects on the filament cannot develop This provision is particularly advantageous in connection with the use of low-voltage lamps, in particular halogen lamps, for illuminating the oven space, because such lamps have particularly small dimensions both in terms of the incandescent coil and of the glass bulb surrounding the coil. Thus the duct opening of the electrically conductive disk for the lamp that is electrically conductively connected to the baking space wall can be correspondingly small, so that the ground potential of the housing wall through this disk is in fact shifted to quite near the area of the incandescent coil of the bulb.

In accordance with another feature of the invention, the disk is recessed or disposed between the incandescent filament the oven chamber wall. The protective action for the coil of the bulb is maintained virtually completely in this case and yet this feature makes it possible to improve the light yield for the baking space.

This is the case especially and additionally if in accordance with a further feature of the invention, the disk is metal and has a light-reflecting surface facing into the baking chamber.

In accordance with a concomitant feature of the invention, the lamp base has metal contacting elements with a given length, the socket has voltage-carrying contact parts, and the disk is spaced from the voltage-carrying contact parts by a distance greater than the given length. Thus the disk which is formed of electrically conductive material and is protectively grounded through electrical connection with the appliance wall, also serves to prevent it from being touched by persons operating the appliance. In this way, contact with parts carrying voltage or with parts that are defectively acted upon by voltage is prevented, especially when the bulb is being changed.

Other features which are considered as characteristic for the invention are set forth in the appended claims.

Although the invention is illustrated and described herein as embodied in a lighting device for an oven to be exposed to microwave energy, in particular a household oven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
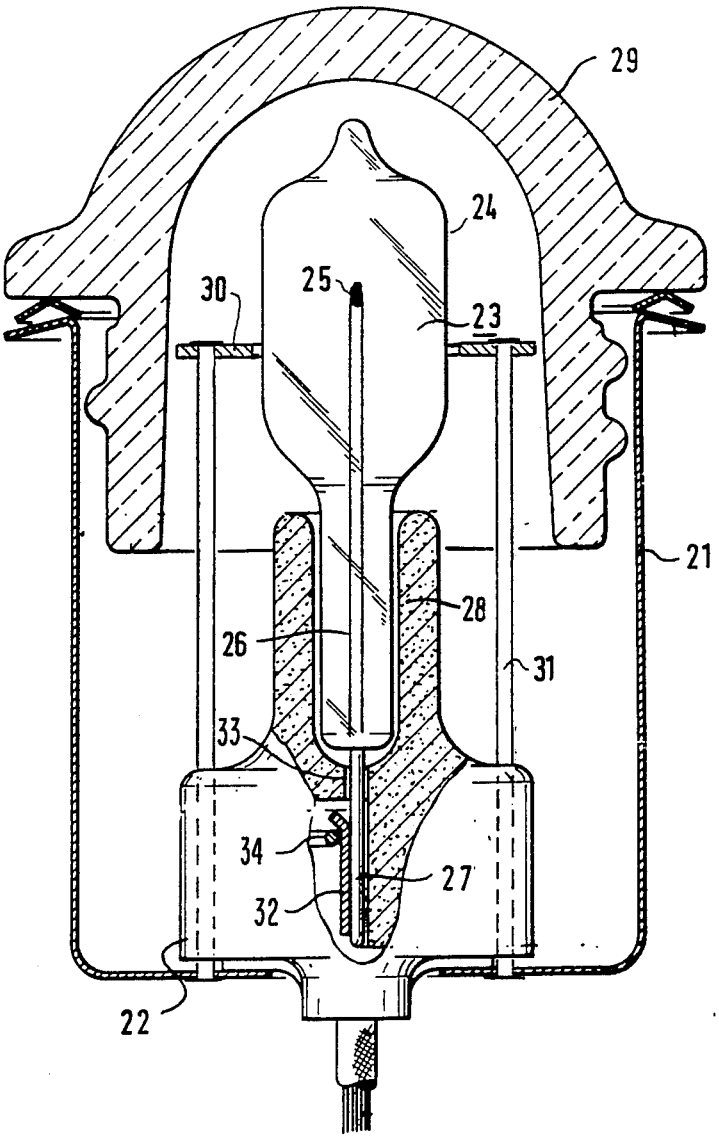

FIG. 1 is a fragmentary, diagrammatic, cross-sectional view of a lighting device disposed on a baking space or chamber wall and protruding into the baking space or chamber, for a household oven that can be acted upon by microwave energy; and FIG. 2 is a partly broken-away, cross-sectional view of an oven light usable in a household oven.

Referring now to the figures of the drawing in detail and first, particularly, to FIG. 1 thereof, there is seen a household oven having a baking space or chamber 1 upon which microwave energy can act. The space or chamber is surrounded on all sides by baking space walls and an oven door. Only a region containing a lighting device for the baking space on a portion 2 of the baking space wall is shown. A bulb holder 3 formed of electrically insulating material is secured on the portion 2 of the wall. Connecting lines 5 lead from sockets 4 of the bulb holder to a current supply device, which is a non-illustrated transformer. The insulation-sheathed connecting lines 5 protrude through duct openings 6 in the wall 2 and have a metal shielding jackets 7 in the vicinity of and adjoining the duct openings 6 which extend between the bulb holder 3 and the wall 2 as well. As a result, relevant emission of microwave energy out of the baking space 1 through the duct holes 6 is reliably prevented, and the required microwave-tightness in this vicinity is thus assured.

Connecting prongs 10 of a halogen lamp 11 are plugged into the sockets 4 of the bulb holder 3. The prongs 10 are extended through a glass base 12 of the halogen lamp 11 in the form of incandescent filament holders 13 extending substantially parallel to one another. A coiled incandescent filament 14 is fastened between the free ends of the filament holders 13 inside the glass bulb of the halogen lamp 11. The halogen lamp 11 and the lamp holder 3 are shaded from the baking space 1 by a glass hood 15, in order to provide protection against unintentional contact by touch, as well as to protect against damage and direct soiling of the halogen lamp 11.

A screen 16 formed of electrically conductive material is provided inside the glass hood 15 parallel to the wall 2, in close vicinity of the filament 14. The screen 16 is a metal disk having a light-reflecting surface facing into the baking chamber. The screen 16 is mechanically and electrically connected to the wall 2 through metal posts 17. The screen 16 raises the ground potential of the wall 2 into a plane near the filament 14 of the lamp 11, so that a microwave field significant enough to damage the incandescent coil cannot develop in this vicinity. A duct opening 18 in the screen 16 of electrically conductive material is formed in such a way that the glass bulb of the lamp 11 can just barely be inserted and protrude through the screen 16 without difficulty.

In FIG. 2, a lamp socket 22 of electrically insulating material, such as ceramic, is secured in a cup-like bulb housing 21 that is open at one end. A lamp 23, preferably a low-voltage bulb, is introduced into the lamp socket 22. An incandescent filament 25 is disposed inside a typically cylindrical bulb 24 of the lamp 23, and the filament is extended out of a glass base through a filament holder 26 to contact prongs 27. The contact prongs 27 pass through plug-in openings 33 in the socket 22 and are kept in contact with electric contact parts 32 of the lamp socket 22 by springs 34. The glass base of the lamp 23 is surrounded by a tubular extension 28 formed onto the socket 22. A lens shaped transparent glass shade 29 is screwed onto a flange of the lamp housing 21, and the shade 29 can be unscrewed for inserting or changing the lamp 23. Similar to the embodiment of FIG. 1, a screen or disk 30 of electrically conductive material is disposed inside the glass shade, in the vicinity of the filament 25. The screen 30 is mechanically and electrically conductively connected through posts 31 to the lamp housing 21, so that the housing potential is raised into the vicinity of the filament 25.

The respective spacings between the screens 16, 30 and the contact elements 4, 32 of the lamp bases 3, 22 is adjusted in such a way as to be greater than the length of the connecting prongs 10, 27 of the lamps 11, 23, in order to ensure that a spacing that is at least in accordance with regulations relating to electrical sparkovers in the case of voltage overloads and leakage paths, is provided between the touchable and/or electrically conductive materials.

I claim:

1. Lighting device for an oven, in particular a household oven, comprising a baking chamber with a wall to be exposed to microwave energy, a lamp socket protruding freely into the baking chamber without a microwave shielding covering, electrical connecting lines supplying the lamp socket with current from outside the baking chamber, an incandescent bulb with a lamp base and an incandescent filament with an incandescent coil being mounted on the lamp socket, and an electrically conductive disk being substantially parallel to and electrically conductively connected to the baking chamber wall, said disk having a duct opening formed therein for the lamp base, and said disk surrounding the incandescent filament in the vicinity of the incandescent coil.

2. Lighting device according to claim 1, wherein said disk is disposed between the incandescent filament the oven chamber wall.

3. Lighting device according to claim 1, wherein said disk is metal and has a light-reflecting surface facing into the baking chamber.

4. Lighting device according to claim 1, wherein the lamp base has metal contacting elements with a given length, said socket has voltage-carrying contact parts, and said disk is spaced from said voltage-carrying contact parts by a distance greater than the given length.

5. In a lighting device for an oven, in particular a household oven, including a baking chamber with a wall to be exposed to microwave energy, a lamp socket protruding freely into the baking chamber without a microwave shielding covering, electrical connecting lines supplying the lamp socket with current from outside the baking chamber, and an incandescent bulb with a lamp base and an incandescent filament with an incandescent coil being mounted on the lamp socket, a shock protection device, the shock protection device comprising an electrically conductive disk being substantially parallel to and electrically conductively connected to the baking chamber wall, said disk having a duct opening formed therein for the lamp base, and said disk surrounding the incandescent filament in the vicinity of the incandescent coil.

* * * * *